US009976438B2

(12) United States Patent
Klauke

(10) Patent No.: US 9,976,438 B2
(45) Date of Patent: May 22, 2018

(54) STATOR VANE ADJUSTING DEVICE OF A GAS TURBINE

(71) Applicant: Rolls-Royce Deutschland Ltd & Co KG, Blankenfelde-Mahlow (DE)

(72) Inventor: Thomas Klauke, Luebbenau/Spree (DE)

(73) Assignee: Rolls-Royce Detschland Ltd & Co KG, Blankenfelde Mahlow (DE)

( * ) Notice: Subject to any disclaimer, the term of this patent is extended or adjusted under 35 U.S.C. 154(b) by 165 days.

(21) Appl. No.: 14/861,616

(22) Filed: Sep. 22, 2015

(65) Prior Publication Data

US 2016/0090856 A1 Mar. 31, 2016

(30) Foreign Application Priority Data

Sep. 26, 2014 (DE) ..... 10 2014 219 552

(51) Int. Cl.
*F01D 17/16* (2006.01)
*F01D 17/14* (2006.01)
(Continued)

(52) U.S. Cl.
CPC ..... *F01D 17/14* (2013.01); *F01D 9/041* (2013.01); *F01D 17/162* (2013.01); *F01D 25/16* (2013.01);
(Continued)

(58) Field of Classification Search
CPC ..... F01D 17/14; F01D 17/162; F01D 9/041; F01D 25/16; F04D 29/563;
(Continued)

(56) References Cited

U.S. PATENT DOCUMENTS 4,812,106 A * 3/1989 Purgavie ..... F01D 17/162 415/160
4,925,364 A * 5/1990 Das ..... F01D 17/162 415/162
(Continued)

FOREIGN PATENT DOCUMENTS

DE 68903485 T2 4/1993
EP 1403467 A2 3/2004
(Continued)

OTHER PUBLICATIONS

German Search Report dated Jul. 13, 2015 from counterpart App No. 10 2014 219 552.7.
(Continued)

*Primary Examiner* — Richard Edgar
(74) *Attorney, Agent, or Firm* — Shuttleworth & Ingersoll, PLC; Timothy Klima

(57) ABSTRACT

A stator vane adjusting device of a gas turbine having a plurality of stator vanes each swivellable about a radial axis and arranged in at least one radial plane, as well as at least one stator vane adjusting ring which is connected to the respective stator vanes and rotatable in the circumferential direction by means of an actuating device, where the stator vane adjusting ring is braced on a centrally arranged casing in the radial direction by means of several spacers distributed about the circumference and mounted on the stator vane adjusting ring, characterized in that a bush on which the spacer is mounted is fastened to the stator vane adjusting ring for each spacer, the bush being made from a plastic material with a high thermal expansion coefficient.

19 Claims, 5 Drawing Sheets

Figure 1:
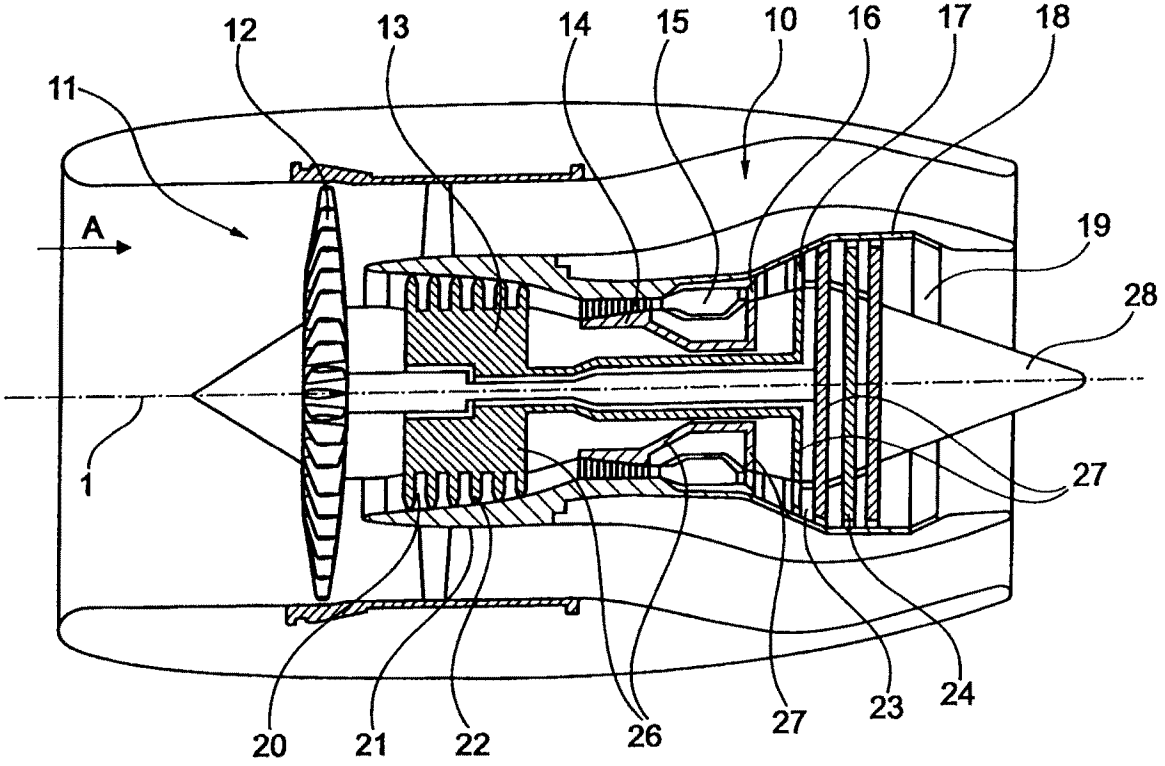

(51) Int. Cl.

| | |
|---|---|
| ***F04D 29/56*** | (2006.01) |
| ***F01D 9/04*** | (2006.01) |
| ***F01D 25/16*** | (2006.01) |

(52) U.S. Cl.

CPC ..... *F04D 29/563* (2013.01); *F05D 2220/32* (2013.01); *F05D 2230/642* (2013.01); *F05D 2240/12* (2013.01); *F05D 2240/80* (2013.01); *F05D 2260/31* (2013.01); *F05D 2300/171* (2013.01); *F05D 2300/174* (2013.01); *F05D 2300/434* (2013.01); *F05D 2300/5021* (2013.01); *F05D 2300/603* (2013.01)

(58) Field of Classification Search

CPC ..... F05D 2220/32; F05D 2230/642; F05D 2240/12; F05D 2240/80; F05D 2260/31; F05D 2300/171; F05D 2300/174; F05D 2300/434; F05D 2300/5021; F05D 2300/603

See application file for complete search history.

(56) References Cited

U.S. PATENT DOCUMENTS

| | | | |
|---|---|---|---|
| 2009/0162192 | A1 | 6/2009 | McCaffrey |
| 2010/0278639 | A1 | 11/2010 | Hood et al. |

FOREIGN PATENT DOCUMENTS

| | | | |
|---|---|---|---|
| EP | 2107217 | A1 | 10/2009 |
| EP | 2258926 | A2 | 12/2010 |
| EP | 2481892 | A2 | 8/2012 |
| GB | 2206381 | A | 1/1989 |
| GB | 2273744 | A | 6/1994 |

OTHER PUBLICATIONS

European Search Report dated Feb. 10, 2016 for counterpart European application No. 15186114.7.

* cited by examiner

STATOR VANE ADJUSTING DEVICE OF A GAS TURBINE

This application claims priority to German Patent Application 102014219552.7 filed Sep. 26, 2014, the entirety of which is incorporated by reference herein.

This invention relates to a stator vane adjusting device for a compressor or a turbine of a gas turbine.

In detail, the invention relates to a stator vane adjusting device for a compressor or a turbine having a plurality of stator vanes each swivellable about a radial axis and arranged in at least one radial plane. The stator vanes thus form a disk-shaped arrangement, where rotor blades are arranged upstream and downstream in the flow direction, as is known from the state of the art.

For adjustment of the stator vanes of each disk-shaped arrangement of stator vanes, a stator vane adjusting ring is provided which is rotatable in the circumferential direction. The stator vane adjusting ring is connected to the respective stator vane using a lever mechanism, such that when the stator vane adjusting ring is rotated the stator vanes are swiveled about their radial axes. The stator vane adjusting ring is connected to a suitable actuating device.

Arrangements of this type are already known from EP 2 258 926 A2, US 2009/0162192 A1 or US 2010/0278639 A1, for example.

The stator vane adjusting ring, which is rotatable in the circumferential direction relative to a casing by means of a drive mechanism for precise adjustment of the stator vanes, is, in accordance with the state of the art, braced against the casing and centered relative thereto by means of spacers arranged evenly distributed about its circumference. During operation of the gas turbine, the casing heats up more than the stator vane adjusting ring. This reduces the radial distance between the casing and the spacers connected to the stator vane adjusting ring. To prevent any sticking between the spacers and the casing due to differing thermal expansions during operation, a clearance or cold gap is provided between said spacers and the casing in accordance with the state of the art and is present in the cold operating state of the components. As a result of these gaps or distances of the spacers to the surface of the casing, both radial and tangential mispositioning of the stator vane adjusting ring relative to the casing occurs in certain operating states. This in turn leads to mispositioning of the stator vanes or guide vanes over the circumference of the stator vane arrangement, from which results an incorrect setting of the stator vanes. Furthermore, mispositioning can lead to increased aerodynamic excitations of adjacent rotor blades and/or stator vanes.

It is thus possible by means of the actuating device to adapt the pitch angle of the respective stator vane to the operating conditions of the compressor or turbine. This may involve the disadvantage, in the case of devices known from the state of the art, that the adjustment of the stator vanes becomes imprecise due to thermal effects.

The object underlying the present invention is to provide a stator vane adjusting device for a compressor or a turbine of a gas turbine of the type specified at the beginning which, while being simply designed and easily and cost-effectively producible, avoids the disadvantages of the state of the art and enables precise adjustment of the stator vanes even with differing thermal expansions.

It is a particular object to provide a solution to the above problems by a combination of features disclosed herein. Further advantageous embodiments will become apparent from the present disclosure.

It is thus provided in accordance with the invention that a bush made from a plastic or composite and on which the spacer is mounted is fastened to the stator vane adjusting ring for each spacer. The bush is made from a plastic or composite material with a high thermal expansion coefficient. Due to the high thermal expansion, the spacer (centraliser) is, during heating up, moved radially outwards by a higher amount than the surrounding stator vane adjusting ring (unison ring). In accordance with the invention, the greater radial expansion of the casing compared with the adjusting ring when the casing heats up during operation can therefore be compensated in that the spacer is moved radially outwards corresponding to this thermal expansion of the casing. This radial movement is effected by the thermal expansion of the bush, which expands more than the stator vane adjusting ring. Hence the bush draws the spacer radially outwards, adjusted to the thermal expansion of the casing. A thermal expansion coefficient of the bush is thus higher than a thermal expansion coefficient of the stator vane adjusting ring. It is thus possible to keep the spacer always in contact or at a predetermined gap dimension from the surface of the casing. This prevents too great distances or gap dimensions which might lead to mispositioning of the stator vane adjusting ring. It also prevents the spacer from sticking on the surface of the casing, which leads to higher adjustment forces or to blocking of the adjusting mechanism.

The amount of thermal expansion of the bush and hence the radial movement of the spacer can, in accordance with the invention, be adapted using the length of the bush, the bush material and also the material of the spacer.

The solution in accordance with the invention thus involves the advantage that mispositioning of the guide vanes or stator vanes can be reduced or completely prevented. This leads to a more exact flow onto both the stator vanes and the rotor blades and hence to a lower fuel consumption. Furthermore, both the aerodynamic excitation of adjacent rotor blades and/or stator vanes and the adjustment forces of the adjusting system are reduced by preventing sticking of the spacers on the casing.

In a particularly favourable embodiment of the invention, it is provided that the bush is designed tube-like and that the spacer has a shaft centrally fastened inside the bush. The shaft can thus be mounted at a suitable point in the bush, while the remaining length of the shaft can slide inside the bush in the radial direction (axial direction of the bush). The shaft is preferably fastened to the radially outer area of the bush, while the bush is preferably fastened to the stator vane adjusting ring at a radially inner side of the latter or fixed thereto in another way.

For setting the distance between the spacer and the surface of the casing, it is favourable when the shaft is bolted to the bush. The gap dimension between the spacer and the surface of the casing can thus be set by rotating the shaft.

In a further preferred embodiment, the thermal expansion coefficient of the bush is higher than a thermal expansion coefficient of the spacer and/or a thermal expansion coefficient of the casing.

The thermal expansion coefficient of the plastic or composite bush is preferably at least double the size of the thermal expansion coefficient of the stator vane adjusting ring and/or of the spacer and/or of the casing. The stator vane adjusting ring, the spacer and the casing are preferably manufactured from the same material, in particular from a high-strength steel alloy with $\alpha=10/13\times10^{-6}$ mm/mmK or from a titanium alloy with $\alpha=8/10\times10^{-6}$ mm/mmK. The bush is preferably made of polyimide.

Figure 2:
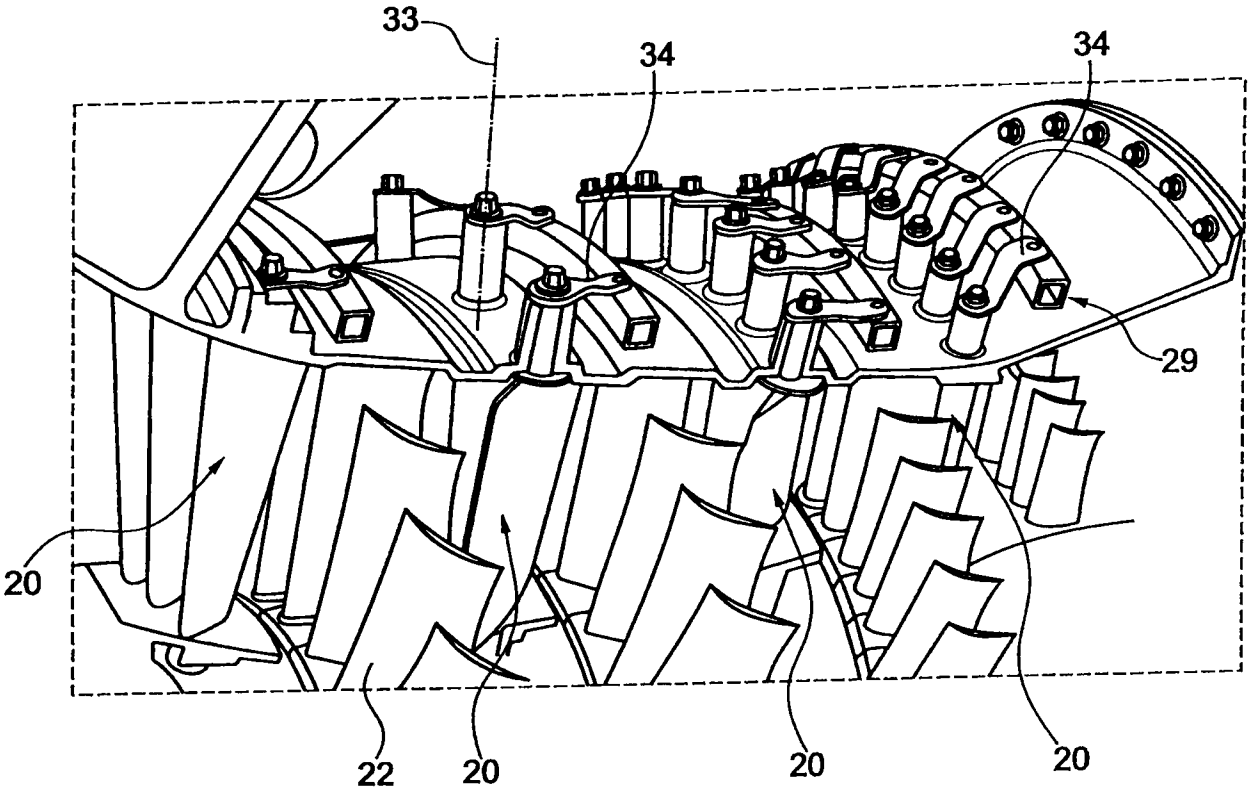
Figure 3:
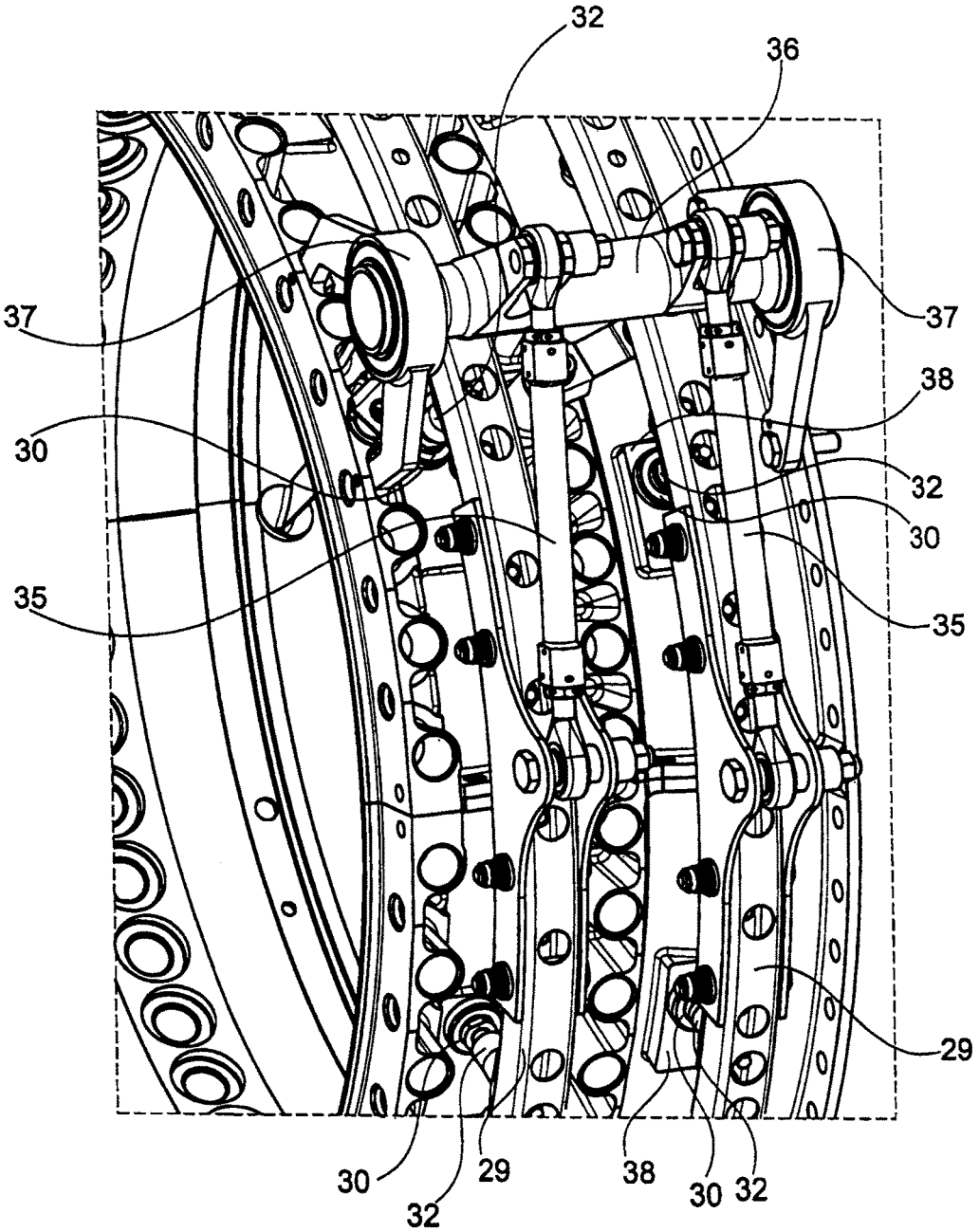
Figure 4:
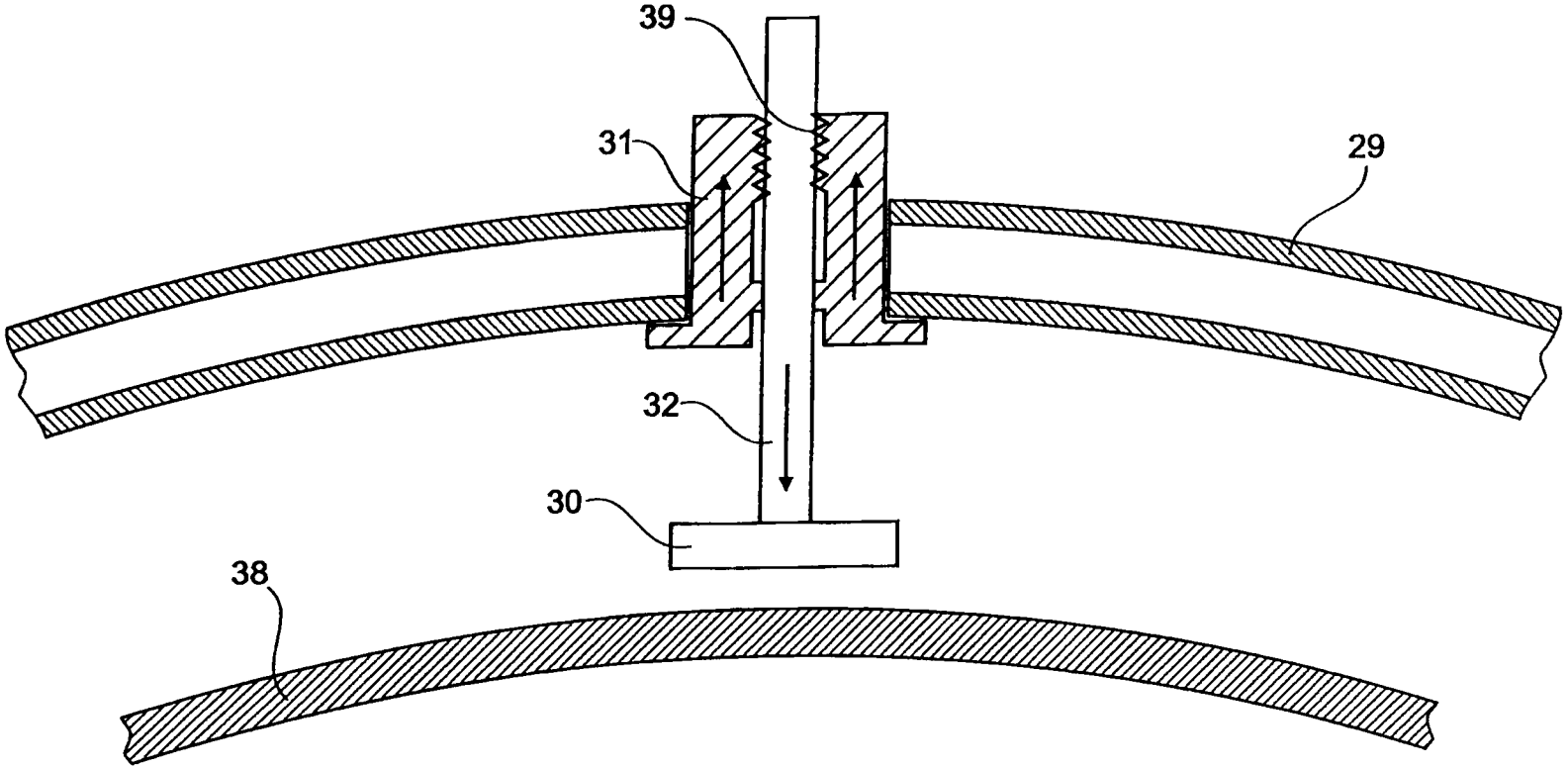
Figure 5:
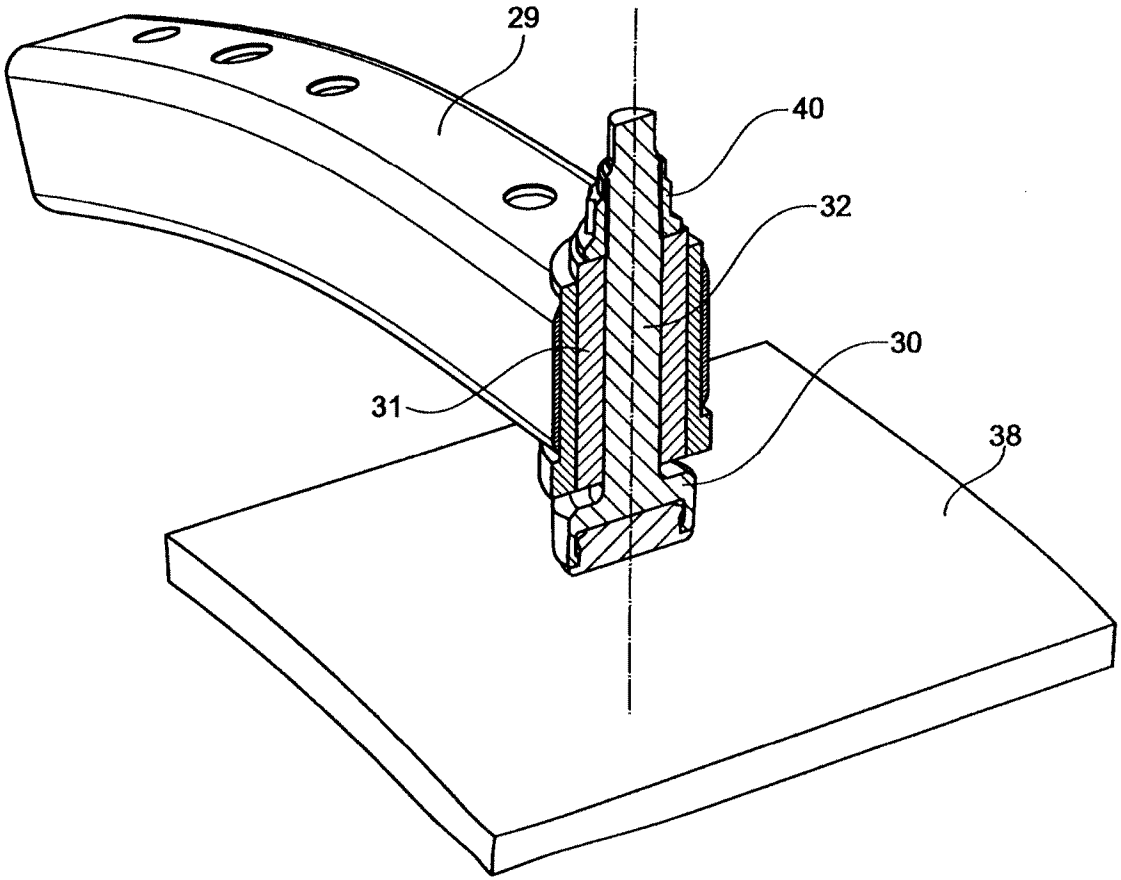

The present invention is described in the following in light of the accompanying drawing, showing an exemplary embodiment. In the drawing, FIG. 1 shows a schematic representation of a gas-turbine engine in accordance with the present invention, FIG. 2 shows a perspective partial view of a compressor with adjustable stator vanes and stator vane adjusting rings, FIG. 3 shows a detail view, by analogy with FIG. 2, FIG. 4 shows an exemplary embodiment of the inventive mounting of the spacer in a radial sectional plane, and FIG. 5 shows a further exemplary embodiment in a perspective sectional view.

The gas-turbine engine 10 in accordance with FIG. 1 is an example of a turbomachine where the invention can be used. The following however makes clear that the invention can also be used in other turbomachines. The engine 10 is of conventional design and includes in the flow direction, one behind the other, an air inlet 11, a fan 12 rotating inside a casing, an intermediate-pressure compressor 13, a high-pressure compressor 14, combustion chambers 15, a high-pressure turbine 16, an intermediate-pressure turbine 17 and a low-pressure turbine 18 as well as an exhaust nozzle 19, all of which being arranged about a center engine axis 1.

The intermediate-pressure compressor 13 and the high-pressure compressor 14 each include several stages, of which each has an arrangement extending in the circumferential direction of fixed and stationary guide vanes, generally referred to as stator vanes 20 and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of stator vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

The present invention is described in the following on the basis of a compressor, it is however also applicable to stator vanes of a turbine.

FIG. 2 shows a perspective partial view of a compressor having several rows of adjustable stator vanes 20, between which compressor rotor blades 22 are arranged in each case. The individual stator vanes 20 are in each case swivellable about a radial axis 33. They are connected to a lever 34 which at its opposite end area is rotatably connected to a stator vane adjusting ring 29. Rotating the stator vane adjusting ring 29 in the circumferential direction results in swiveling of the individual levers 34. The effect of this is a rotation of the stator vanes 20 about the respective axis 33.

An actuating device, not shown, which is for example designed as a piston-cylinder unit, is connected to a crankshaft 36 by one each connection rod (not shown), as is illustrated in FIG. 3. The crankshaft 36 is mounted by means of bearings 37. The crankshaft 36 is furthermore connected to the stator vane adjusting rings 29 by means of connection rods 35. Operating the actuating device thus leads to rotation or swiveling of the crankshaft 36, which in turn leads to a rotation of the respective stator vane adjusting ring 29, since the crankshaft 36 is connected to the stator vane adjusting ring 29 by a connection rod 35.

FIG. 3 furthermore shows several spacers 30 arranged distributed around the circumference, which (see also FIG. 4 described in the following) have a shaft 32 settably mounted on the stator vane adjusting ring 29. The spacer is in contact with the surface of the casing 38 and is moved together with the stator vane adjusting ring 29 in the circumferential direction. The spacer centers the stator vane adjusting ring 29 in the radial direction relative to the casing 38. In the illustration of FIG. 3 the casing 38 has suitable bases or contact surfaces or similar at those areas which the spacer 30 contacts.

FIG. 4 shows an exemplary embodiment of the solution in accordance with the invention in detail in a sectional view of a radial plane. The casing 38 is shown only schematically here and has a distance from the spacer 30 which is shown oversized for better illustration.

A bush 31 made from a plastic or composite material is mounted on the stator vane adjusting ring 29. This bush is designed in the shape of a sleeve and has a central recess in which the shaft 32 of the spacer 30 is mounted. The shaft 32 is mounted on a radially outer area of the bush 31 by means of a thread 39. Rotating the shaft 32 thus makes it possible to adjust the radial position of the spacer 30.

FIG. 4 shows a schematic view to illustrate the radial movements resulting from the thermal expansions. For example, heating up with a value of $\Delta T=70$ K is assumed here. With heating of this type of the casing 38 (in this example high-strength steel alloy with $\alpha=10/13\times10^{-6}$ mm/mmK, alternatively also titanium alloys with $\alpha=8/10\times10^{-6}$ mm/mmK), the casing expands in the example shown radially by 0.3 mm. The plastic or composite material of the bush 31 with $\alpha=20/50\times10^{-6}$ mm/mmK would expand by an amount of 0.42 mm. The shaft 32 and the adjusting ring 29 undergo a total length change of 0.08 mm (expansion coefficient $\alpha=10/13\times10^{-6}$ mm/mmK). This leads to a total radial outward movement of the spacer 30 of 0.34 mm, meaning that the distance between the spacer 30 and the surface of the casing 38 remains substantially constant, so that even with this increase in the temperature the stator vane adjusting ring 29 is precisely centered.

FIG. 5 shows a further exemplary embodiment, where identical parts are identified with the same reference numerals. The shaft 32 has a thread at its end and is adjustably secured by means of a nut 40 which is connected to the bush 31.

LIST OF REFERENCE NUMERALS

1 Engine axis
10 Gas-turbine engine
11 Air inlet
12 Fan rotating inside the casing
13 Intermediate-pressure compressor
14 High-pressure compressor
15 Combustion chambers
16 High-pressure turbine
17 Intermediate-pressure turbine
18 Low-pressure turbine
19 Exhaust nozzle
20 Stator vanes
21 Engine casing
22 Compressor rotor blades
23 Stator vanes
24 Turbine blades
26 Compressor drum or disk
27 Turbine rotor hub
28 Exhaust cone

29 Stator vane adjusting ring
30 Spacer
31 Bush
32 Shaft
33 Axis
34 Lever
35 Connection rod
36 Crankshaft
37 Bearing
38 Casing
39 Thread
40 Nut

What is claimed is:

1. A stator vane adjusting device of a gas turbine having a plurality of stator vanes each swivellable about a radial axis and arranged in at least one radial plane, comprising:

a stator vane adjusting ring connected to the plurality of stator vanes and rotatable in a circumferential direction by an actuating device, a plurality of spacers distributed about a circumference of the stator vane adjusting ring and mounted on the stator vane adjusting ring for bracing the stator vane adjusting ring in a radial direction on a centrally arranged casing of the gas turbine, for each of the plurality of spacers, a bush for mounting the spacer, the bush being fastened to the stator vane adjusting ring at a first position of the bush, the bush being made from a plastic or composite material with a higher thermal expansion coefficient than a thermal expansion coefficient of the stator vane adjusting ring, the spacer mounted to the bush at a second position of the bush radially outwardly of the first position of the bush such that, during operation of the gas turbine, the higher thermal expansion coefficient of the bush causes the spacer to move radially outwardly with respect to the stator vane adjusting ring;

the spacer including a radially outwardly facing portion positioned directly radially inwardly of an inwardly facing portion of the bush, the spacer mounted to the bush such that the radially outwardly facing portion of the spacer is spaced radially inwardly apart from the radially inwardly facing portion of the bush such that the radially outwardly facing portion of the spacer does not engage the radially inwardly facing portion of the bush and radially outward movement of the radially outwardly facing portion of the spacer is not limited by the radially inwardly facing portion of the bush during the operation of the gas turbine.

2. The stator vane adjusting device in accordance with claim 1, wherein the bush is tubular and the spacer has a shaft centrally fastened inside the bush.

3. The stator vane adjusting device in accordance with claim 2, wherein the shaft is connected to the bush by a threaded connection.

4. The stator vane adjusting device in accordance with claim 3, wherein the bush is fastened to a radially inner side of the stator vane adjusting ring.

5. The stator vane adjusting device in accordance with claim 4, wherein the shaft is adjustable relative to the bush in the radial direction.

6. The stator vane adjusting device in accordance with claim 5, wherein the shaft is made from a metallic material having a similar or same thermal expansion coefficient as at least one chosen from the casing and the stator vane adjusting ring.

7. The stator vane adjusting device in accordance with claim 6, wherein the thermal expansion coefficient of the bush is higher than a thermal expansion coefficient of at least one chosen from the spacer and the casing.

8. The stator vane adjusting device in accordance with claim 7, wherein the thermal expansion coefficient of the bush is at least double the thermal expansion coefficient of at least one chosen from the stator vane adjusting ring, the spacer and the casing.

9. The stator vane adjusting device in accordance with claim 8, wherein the bush is made of polyimide.

10. The stator vane adjusting device in accordance with claim 9, wherein the stator vane adjusting ring and the spacer and the casing are manufactured from a high-strength steel alloy or from a titanium alloy.

11. The stator vane adjusting device in accordance with claim 1, wherein the bush is fastened to a radially inner side of the stator vane adjusting ring.

12. The stator vane adjusting device in accordance with claim 2, wherein the shaft is adjustable relative to the bush in the radial direction.

13. The stator vane adjusting device in accordance with claim 2, wherein the shaft is made from a metallic material having a similar or same thermal expansion coefficient as at least one chosen from the casing and the stator vane adjusting ring.

14. The stator vane adjusting device in accordance with claim 13, wherein the thermal expansion coefficient of the bush is higher than a thermal expansion coefficient of at least one chosen from the spacer and the casing.

15. The stator vane adjusting device in accordance with claim 13, wherein the thermal expansion coefficient of the bush is at least double the thermal expansion coefficient of at least one chosen from the stator vane adjusting ring, the spacer and the casing.

16. The stator vane adjusting device in accordance with claim 1, wherein the thermal expansion coefficient of the bush is higher than a thermal expansion coefficient of at least one chosen from the spacer and the casing.

17. The stator vane adjusting device in accordance with claim 1, wherein the thermal expansion coefficient of the bush is at least double the thermal expansion coefficient of at least one chosen from the stator vane adjusting ring, the spacer and the casing.

18. The stator vane adjusting device in accordance with claim 1, wherein the bush is made of polyimide.

19. The stator vane adjusting device in accordance with claim 1, wherein the stator vane adjusting ring and the spacer and the casing are manufactured from a high-strength steel alloy or from a titanium alloy.

* * * * *